US007485412B2

(12) United States Patent
Okano et al.

(10) Patent No.: US 7,485,412 B2
(45) Date of Patent: Feb. 3, 2009

(54) INK JET HEAD MANUFACTURING METHOD AND INK JET HEAD MANUFACTURED BY THE MANUFACTURING METHOD

(75) Inventors: Akihiko Okano, Kanagawa (JP); Shoji Shiba, Kanagawa (JP); Hiroe Ishikura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 109 days.

(21) Appl. No.: 10/576,247

(22) PCT Filed: Jun. 27, 2005

(86) PCT No.: PCT/JP2005/012268

§ 371 (c)(1),
(2), (4) Date: Apr. 18, 2006

(87) PCT Pub. No.: WO2006/001532

PCT Pub. Date: Jan. 5, 2006

(65) Prior Publication Data

US 2007/0132811 A1 Jun. 14, 2007

(30) Foreign Application Priority Data

Jun. 28, 2004 (JP) ..... 2004-190480

(51) Int. Cl.
*B41J 2/01* (2006.01)

(52) U.S. Cl. ..... 430/320; 347/47

(58) Field of Classification Search ..... None
See application file for complete search history.

(56) References Cited

U.S. PATENT DOCUMENTS 4,393,129 A 7/1983 Glashauser et al.

(Continued)

FOREIGN PATENT DOCUMENTS

EP 0 734 866 A 10/1996

(Continued)

OTHER PUBLICATIONS

Computer-generated translation of JP 2004-042396, Feb. 2004.*

(Continued)

*Primary Examiner*—John A. McPherson
(74) *Attorney, Agent, or Firm*—Fitzpatrick, Cella, Harper & Scinto

(57) ABSTRACT

A method of manufacturing an ink jet head, which includes a discharge port for discharging an ink droplet, an ink flow path communicated with the discharge port, and an energy generating element for discharging the ink droplet from the discharge port, includes providing a photodegradable resin layer on a substrate having the energy generating element, forming a structure which becomes the ink flow path by exposing and developing the photodegradable resin layer, coating the substrate having the structure which becomes the ink flow path with a negative type photosensitive resin layer, forming the ink discharge port in the negative type photosensitive resin layer, and forming the ink flow path communicated with the discharge port by removing the structure which becomes the ink flow path. The photodegradable resin layer includes a binary acrylic copolymer composition, which contains a unit obtained from (meta)acrylic ester as a main component and further contains a unit obtained from (meta)acrylic acid. The composition contains the (meta)acrylic acid unit at a proportion of 5 to 30 weight %, and a weight average molecular weight of the composition ranges from 50000 to 300000.

11 Claims, 3 Drawing Sheets

U.S. PATENT DOCUMENTS

| | | | |
|---|---|---|---|
| 4,657,631 | A | 4/1987 | Noguchi |
| 5,916,452 | A | 6/1999 | Kobayashi et al. |
| 6,123,863 | A | 9/2000 | Shimomura et al. |
| 6,318,842 | B1 | 11/2001 | Shimomura et al. |
| 6,455,112 | B1 | 9/2002 | Ohkuma et al. |
| 6,461,798 | B1 | 10/2002 | Ohkuma et al. |
| 2004/0072107 | A1 | 4/2004 | Kubota et al. |
| 2006/0277755 | A1 | 12/2006 | Kubota et al. |
| 2007/0099121 | A1 | 5/2007 | Kubota et al. |

FOREIGN PATENT DOCUMENTS

| | | | |
|---|---|---|---|
| EP | 0 814 380 | A | 12/1997 |
| EP | 1 380 423 | A | 1/2004 |
| EP | 1 380 425 | A | 1/2004 |
| JP | 57-100429 | | 6/1982 |
| JP | 61-154947 | | 7/1986 |
| JP | 8-323985 | A | 12/1996 |
| JP | 3143308 | B | 12/2000 |
| JP | 2004-42396 | A | 2/2004 |
| KR | 2004-5699 | | 1/2004 |

OTHER PUBLICATIONS

International Preliminary Report on Patentability in PCT Application No. PCT/JP2005/012268, dated Jan. 11, 2007.

* cited by examiner

INK JET HEAD MANUFACTURING METHOD AND INK JET HEAD MANUFACTURED BY THE MANUFACTURING METHOD

TECHNICAL FIELD

The present invention relates to a method for manufacturing an ink jet head and an ink jet head.

BACKGROUND ART

The ink jet head is applied to an ink jet recording method (liquid discharge recording method) in which the recording is performed by discharging a recording solution such as ink. The ink jet head generally includes an ink flow path, a liquid discharge energy generating portion provided in a part of the ink flow path, and a fine ink discharge port (also referred to as "orifice") for discharging the ink in the ink flow path by energy of the liquid discharge energy generating portion. With reference to the conventional method of producing the ink jet head, for example, Japanese Patent Publication No. HO 6-045242 discloses a method for manufacturing an ink jet head (also referred to as cast molding method) in which a mold of the ink flow path is patterned onto the substrate, in which liquid discharge energy generating elements are formed, by a photosensitive material, a coating resin layer is applied onto the substrate so that the mold pattern is coated, an ink discharge port communicated with the mold of the ink flow path is formed in the coated resin layer, and then the photosensitive material used for the mold is removed. From the viewpoint of easy removal, a positive type resist is used as the photosensitive material in the method for manufacturing an ink jet head. Further, according to the method for manufacturing an ink jet head, because a technique of semiconductor lithography is applied, fine processing can be realized with extremely high accuracy for the formation of the ink flow path, the ink discharge port, and the like.

However, since a negative type resist is applied onto the ink flow path pattern formed by the positive type resist, sometimes there is generated a problem that the ink flow path pattern is dissolved and deformed during the application of the negative type resist.

In order to avoid the problem in the conventional ink flow path patterning, for example, Japanese Patent Application Laid-Open No. H08-323985 discloses a method in which the negative type resist is applied after solvent-resistance properties are improved by performing intermolecular crosslinking with an ionizing radiation decomposition type photosensitive resin composition including an intermolecular crosslinkable structural unit. It is the method of performing the intermolecular crosslinking by baking the photosensitive resin containing an 8/2 copolymer (weight average molecular weight is 180000) of methyl methacrylate/methacrylic acid at 180° C. for one hour.

Further, in Japanese Patent Application Laid-Open No. 2004-042396, the inventors propose that an acrylic copolymer containing methacrylate ester as a main component as the further preferable acrylic resin, containing methacrylic acid as a thermal crosslinking factor at a proportion of 2 to 30 weight %, and whose molecular weight ranges 5000 to 50000, is used by performing thermal crosslinking of acrylic copolymer for the,positive type resist for forming the ink flow path.

According to these methods, although the deformation of the ink flow path pattern can be prevented, the following problems still exist:

(1) Due to the intermolecular crosslinking, a large amount of energy is required for a photodegradation reaction of the positive type resist, and sensitivity tends to decrease. Further, because progress of the photodegradation reaction is insufficient, particularly when the positive type resist is used in a thick film, sometimes a decrease in resolution is generated.

(2) When the positive type resist is used in the thick film, sometimes a crack is generated by curing shrinkage stress associated with the intermolecular crosslinking. Further, sometimes the crack is generated in development or in the application of the negative type resist.

(3) In order to impart the sufficient solvent-resistance properties, heat treatment is required at high temperatures for a long time.

Therefore, a width or a height of the ink flow path is restricted, which results in not only an obstacle of ink flow path design but also a decrease in production.

DISCLOSURE OF THE INVENTION

In view of the foregoing, the invention provides particularly effective, novel means as the method for manufacturing an ink jet head when the high-density ink jet head is manufactured at high throughput. When particularly acrylic resins are used as the positive type resist for forming the flow path, the invention focuses the point that the generation of the crack is prevented by using a specific developing solution, the progress of the intermolecular crosslinking is suppressed as much as possible, and a polarity of a (meta)acrylic resin is controlled by changing a proportion of a (meta)acrylic acid component in the resin, which improves the sensitivity for the developing solution. The invention also focuses the point that the dissolution and deformation of the ink flow path pattern formed by the positive type resist are prevented by using a specific organic solvent as application solvent of the negative type resist and the generation of the crack can be suppressed to coat the ink flow path pattern with the negative type resist.

A method of manufacturing an ink jet head. which includes a discharge port for discharging an ink droplet, an ink flow path communicated with the discharge port, and an energy generating element for discharging the ink droplet from the discharge port, is characterized by including providing a photodegradable resin layer on a substrate having the energy generating element; forming a structure which becomes the ink flow path by exposing and developing the photodegradable resin layer; coating the substrate having the structure which becomes the ink flow path with a negative type photosensitive resin layer; forming the ink discharge port in the negative type photosensitive resin layer; and forming the ink flow path communicated with the discharge port by removing the structure which becomes the ink flow path. The photodegradable resin layer includes a binary acrylic copolymer composition, which contains a unit obtained from (meta)acrylic ester as a main component, and further contains a unit obtained from (meta)acrylic acid. The composition contains the (meta)acrylic acid unit at a proportion of 5 to 30 weight %, more preferably at a proportion of 5 to 15 weight %, and a weight average molecular weight of the composition ranges from 50000 to 300000.

An ink jet head according to the invention is characterized in the ink jet head is manufactured by the manufacturing method.

According to the method for manufacturing an ink jet head, a method for manufacturing the high-density-ink jet-head in which yield improvement and crack suppression by the increase in sensitivity, high throughput by low-temperature formation of the ink flow path, and the like are realized can be provided.

BEST MODE FOR CARRYING OUT THE INVENTION

Figure 1:
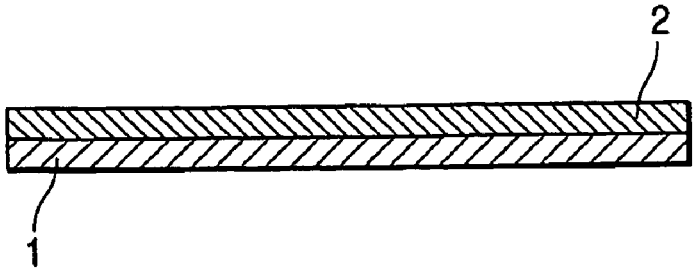
FIG. 1 is a schematic sectional view showing a state in which a positive type resist layer is formed on a substrate.

A photodegradable positive type resist used in the invention is an acrylic copolymer composition, in which a unit obtained from at least (meta)acrylic ester is contained as the main component and a unit obtained from (meta)acrylic acid is further contained. The unit expressed by General Formula (1) can be cited as the preferable (meta)acrylic ester unit, and the unit expressed by General Formula (2) can be cited as the preferable (meta)acrylic acid unit.

General Formula (1)

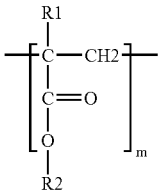

(Where R1 is a hydrogen and an alkyl group in which carbon numbers range 1 to 3, R2 is the alkyl group in which the carbon numbers ranges 1 to 3, and m is a positive integer.)

General Formula (2)

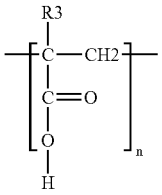

(Where R3 is the hydrogen and the alkyl group in which carbon numbers range 1 to 3 and n is a positive integer.)

At least, the unit of General Formula (1) can be cited as the unit obtained from (meta)acrylic ester, and the unit of General Formula (2) can be cited as the unit obtained from (meta) acrylic acid.

Referring now to the drawings, the invention will be described in detail in each process. FIGS. 1 to 7 schematically show a method for manufacturing an ink jet head of the invention.

Process 1: Positive Type Resist Layer Formation

In the invention, first a photodegradable positive type resist layer 2 is formed on a substrate 1 having the energy generating element (FIG. 1). The substrate 1 includes the energy generating element (not shown) for discharging the ink. The substrate made of materials such as glass, ceramic, metal, and the like is used as the substrate 1 used in the invention. An electrothermal generating element or a piezoelectric element is used as the energy generating element. However, the energy generating element is not limited to these elements. When the electrothermal generating element is used as the energy generating element, it is possible that a protection film (not shown) is formed for the purposes of impact relaxation during bubbling or damage reduction from the ink and the like.

The photodegradable positive type resist is applied onto the surface of the substrate 1 to form the positive type resist layer 2. Examples of applying method include a spin coating method, a direct coating method, and a laminate transferring method. However, the applying method is not limited to the above examples. The resists such as polymethyl isopropenyl ketone (PMIPK) or polyvinyl ketone having a photosensitive wavelength range near 290 nm and the resists, made of a high molecular compound containing a methacrylate ester unit such as polymethyl methacrylate (PMMA), having a photosensitive wavelength range near 250 nm are generally used as the photodegradable positive type resist. In these resists, the decrease in molecular weight by photoirradiation is utilized, a developing solution in which the base resin is not dissolved is used to dissolve only a part where the molecular weight is decreased into the developing solution, and thereby a positive type image is formed. The acrylic copolymer used in the invention also forms the positive type image by utilizing the progress of the decrease in molecular weight by the photoirradiation, and the conventional problems are solved by focusing attention on a resin polarity of the acrylic copolymer.

In order to prevent the generation of the crack during the development, the invention is characterized by using the developing solution containing the basic component which is mentioned in detail later. However, when the developing solution containing the later-mentioned basic component is used, it is not desirable as described above, since the decreases in sensitivity and resolution occur in the intermolecular-crosslinked acrylic copolymer. Therefore, the acrylic copolymer used in the invention is characterized in that the high-sensitivity resist, in which the crack is hardly generated during the development, is formed such that the intermolecular crosslinking is suppressed as much as possible to optimize the molecular weight and the composition.

Further, in the acrylic copolymer used in the invention, the polarity is largely changed by the content of the (meta)acrylic acid component included in the structure. Namely, the polarity of the acrylic copolymer largely depends on "the proportion of the (meta)acrylic acid component included in the copolymer" and "a degree of the intermolecular crosslinking by the heat treatment (pre-baking)". In the acrylic copolymer containing (meta)acrylic acid in the structure, dehydration and condensation of carboxylic acid progresses to generate the intermolecular crosslinking by the treatment at high temperatures, so that the acrylic copolymer containing (meta) acrylic acid is effective at improving the solvent-resistance properties. However, because the polarity also largely affects solubility against the negative type resist with which the later-mentioned positive type resist is coated, the polarity is decreased by the intermolecular crosslinking. As a result, sometimes the solvent-resistance properties are decreased.

In view of these points, in the invention, the acrylic copolymer is used as the positive type resist at the optimum state by controlling "the proportion of the (meta)acrylic acid" and "the degree of the intermolecular crosslinking by the heat treatment" to adjust the polarity (the amount of (meta)acrylic acid component).

As a result of the earnest study, the inventors found that the acrylic copolymer, in which the (meta)acrylic ester expressed, by General Formula (1) is contained as the main content, the 5 to 30 weight % (meta)acrylic acid component expressed by General Formula (2) is contained, and the weight average molecular weight (conversion of polystylene) ranges from 50000 to 300000, is particularly preferably used.

For example, the (meta)acrylic ester used in the invention can be formed from radical copolymerization using monomers described in the following Formula (3) and Formula (4).

Formula (3)

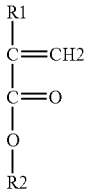

(Where R1 is the hydrogen and the alkyl group in which the carbon numbers range 1 to 3 and R2 is the alkyl group in which the carbon numbers ranges 1 to 3.)

Formula (4)

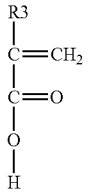

(Where R3 is the hydrogen and the alkyl group in which the carbon numbers range 1 to 3).

"The crack-resistance properties", "the solubility (sensitivity) into the developing solution", and "coating resist-resistance properties (resolution)" can be cited as important factors of the positive type resist for forming the ink flow path used as the ink jet head, and the conditions effective in each characteristic becomes preferable. The type of the later-mentioned developing solution, the degree of the intermolecular crosslinking, and applying solvent of the later-mentioned negative type resist largely affect "the crack-resistance properties" of the acrylic copolymer according to the invention. Specifically, the use of the later-mentioned basic polarity developing solution has large effect in decreasing the crack. Therefore, the crack is hardly generated during developing the positive type resist of the invention, when compared with non-polarity developing solutions such as methyl isobutyl ketone and xylene. As the intermolecular crosslinking progresses, the stress is generated in the copolymer by the curing shrinkage. Therefore, in the copolymer in which the crosslinking progresses to a certain extent, sometimes the crack is generated by the shrinkage associated with the post-prebaking cooling or by rapid swelling during the development. Similarly this phenomenon is likely to occur by the applying solvent of the negative type resist with which the later-mentioned positive type resist is coated, and it is necessary that the solvent by which the crack is not generated is selected as the applying solvent of the negative type resist.

In the acrylic copolymer according to the invention, a relationship between the polarities of the positive type resist and the developing solution largely affects "the solubility (sensitivity) into the developing solution". Specifically, when the polarity developing solution is used for the positive type resist having the high polarity, the solubility is improved. However, when the proportion of the (meta)acrylic acid component is too high, because the polarity is excessively increased as the resin, the decrease in film becomes remarkable in the unexposed portion during the development and viscosity is increased during the polymerization, which causes synthesis to be hardly made. Therefore, the polarity developing solution having excessively high proportion of the (meta)acrylic acid component is not suitable to the positive type resist. When the later-mentioned basic polarity developing solution is used in the invention, the proportion of the (meta)acrylic acid component ranges from 5% to 30%, and the basic polarity developing solution is preferably used on the conditions that the progress of the intermolecular crosslinking is suppressed as much as possible. The solubility is increased in the unexposed portion when the molecular weight is low, and the sensitivity is lowered when the molecular weight is high. Therefore, it is preferable that the positive type resist is used when the molecular weight ranges from 50000 to 300000. Further, when the intermolecular crosslinking is suppressed, the heat treatment is not required at high temperatures for a long time, so that tact is preferably improved.

For the use of the non-polarity developing solution, the lower than 5% proportion of the (meta) acrylic acid component which is the condition of the low polarity of the positive type resist or the progress of the intermolecular crosslinking improves the solubility. However, because the later-mentioned coating resist-resistance properties and the crack-resistance properties are not compatible with each other, it is not suitable to the positive type resist for the ink flow path.

The relationship between the polarity of the positive type resist and the polarity of the applying solvent of the negative type resist largely affects "the coating resist-resistance properties (resolution)" of the acrylic copolymer according to the invention. Specifically, the dissolution and the deformation of the positive type resist can be suppressed to form the ink flow path having the target resolution by coating the positive type resist having the high polarity with the negative type resist having the low polarity. In order to dissolve and deform the positive type resist, it is preferable to use the positive type resist having molecular weights not lower than 50000. The negative type resist suitable to the coating will be described in detail later.

Process 2: Ink Flow Path Pattern Formation

Figure 2:
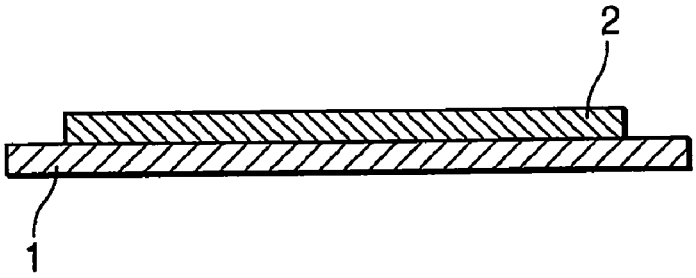
FIG. 2 is a schematic sectional view showing a state in which a structure of an ink flow path is formed in the positive type resist layer.

After the positive type resist layer 2 is formed, a predetermined area of the positive type resist layer 2 is removed through a photolithographic process including an exposure process and a developing process, and the ink flow path pattern is formed (FIG. 2). First the positive type resist layer 2 is irradiated with an ionizing radiation through a quartz mask in which the ink flow path pattern is drawn. At this point, the ionizing radiation including the wavelength range near 250 run which is of the photosensitive wavelength range of the photodegradable positive type resist used in the invention is used as the ionizing radiation. Therefore, in the positive type resist layer 2, a main chain degradation reaction is generated in the area irradiated with the ionizing radiation, and the solubility of the area for the developing solution is selectively improved. Accordingly, the structure which becomes the ink flow path can be formed by developing the positive type resist layer 2.

For the developing solution, any solvent is applicable as long as the solvent does not dissolve the exposed portion where the solubility is improved nor dissolve the unexposed portion. However, in the invention, the crack is prevented during the development. Further, as described above, the invention focuses attention not only on the size of the molecular weight but on the polarity of the resin to achieve the high sensitivity and the high resolution. Therefore, it is preferable to use the basic developing solution. As a result of the earnest study, the inventors found that the developing solution containing (1) glycol ether having carbon numbers not lower than 6, glycol ether being able to be mixed with water at an arbitrary proportion, (2) a nitrogen-containing basic organic solvent, and (3) water is preferably used. For example, Japanese Patent Publication No. H03-010089 discloses a PMMA developing solution which is used as the resist in X-ray lithography, and it is possible that the developing solution having the composition disclosed in Japanese Patent Publication No. H03-010089 is also preferably used in the invention. Each composition can arbitrarily be selected. Particularly, it is preferable to use the developing solution in which (1) ranges from 50% to 70%, (2) ranges from 20% to 30%, and (3) is a remainder.

Process 3: Negative Type Resist Layer Formation

Figure 3:
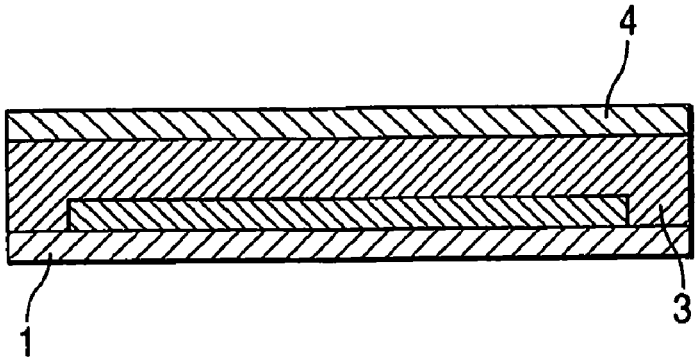
FIG. 3 is a schematic sectional view showing a state in which a negative type resist layer and an ink repellent layer are formed.

Then, the positive type resist forming the ink flow path pattern is coated with a negative type resist layer 3 for forming an ink flow path wall (FIG. 3). The materials in which the reactions such as cationic polymerization and radical polymerization are utilized can be used as the negative type resist. However the negative type resist is not limited to the above materials. Take the negative type resist in which the cationic polymerization reaction is utilized as an example, the polymerization or the crosslinking progress among the monomer or polymer molecules which are included in the negative type resist and able to perform the cationic polymerization by a cation generated from a photo-cationic polymerization initiator included in the negative type resist. Aromatic iodonium salt, aromatic sulfonium salt, and the like can be cited as the photo-cationic polymerization initiator. Specifically, SP-170 and SP-150 (product names) available from ASAHI DENKA CO., LTD. can be cited.

The monomer or polymer having an epoxy group, a vinyl ether group, or an oxetane group is suitable to the monomer or polymer in which the cationic polymerization can be made. However, the monomer or polymer is not limited to the monomer or polymer having an epoxy group, a vinyl ether group, or an oxetane group. Cycloaliphatic epoxy resins such as a bisphenol A-type epoxy resin, a novolac type epoxy resin, Aron oxetane OXT-211 (product name of TOAGOSEI CO., LTD.), and Celloxide 2021 (product name of DAISEL CHEMICAL INDUSTRIES, LTD.) and monoepoxide having a straight-chain alkyl group such as AOE (product name of DAISEL CHEMICAL INDUSTRIES, LTD.) can be cited as an example. Further, a polyfunctional epoxy resin described in Japanese Patent No. 3,143,308, e.g. EHPE-3150 (product name of DAISEL CHEMICAL INDUSTRIES, LTD.) and the like exhibit the extremely high cationic polymerization properties, and exhibit high crosslink density by curing. Therefore, since the cured material having the excellent strength is obtained, EHPE-3150 and the like are particularly preferable.

In the invention, the negative type resist is used while the flow path pattern formed by the positive type resist is coated with the negative type resist. Therefore, it is necessary to select the applying solvent which does not dissolve and deform the positive type resist. As a result of the earnest study, the inventors found that it is preferable that methyl isobutyl ketone or xylene having the opposite polarity to the positive type resist is used as the applying solvent used in the negative type resist.

In order to improve the application properties such as film evenness in forming the application film, it is also preferable that a glycol compound is included in the negative type resist. The compounds such as diethylene glycol dimethyl ether and triethylene glycol methyl ether can be cited as an example. However, the glycol compound is not limited to the above compounds.

The negative type resist layer 3 is formed by applying the negative type resist onto the structure which becomes the ink flow path by the method such as the spin coating method and the direct coating method.

Then, an ink-repellent layer 4 is formed on the negative type resist layer 3 if necessary. In this case, as with the negative type resist, it is desirable that the ink-repellent layer 4 has the photosensitivity by which the intermolecular crosslinking can be made. It is also necessary that the ink-repellent layer 4 and the negative type resist are not compartibilized with each other. The ink-repellent layer 4 can be formed by the methods such as the spin coating method, the direct coating method, and the laminate transfer method.

Process 4: Ink Discharge Port Formation

Figure 4:
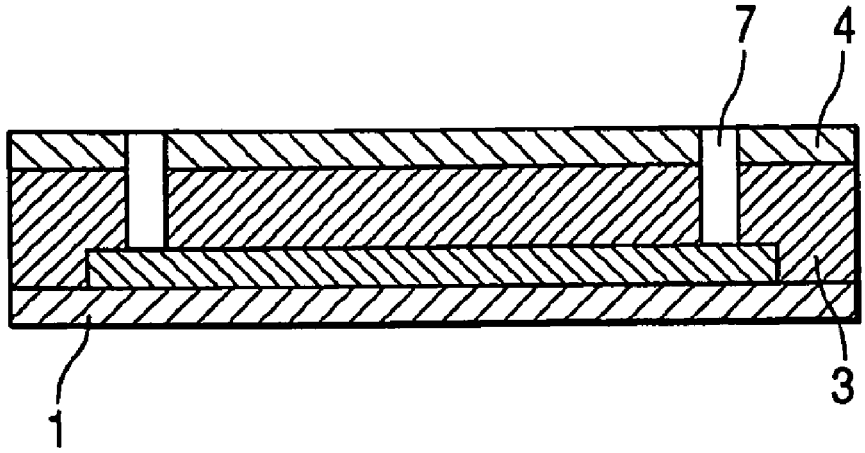
FIG. 4 is a schematic sectional view showing a state in which an ink discharge port is formed.

Then, the ink discharge port is formed in a predetermined portion in the negative type resist layer (FIG. 4). In Process 4, the portion which becomes the ink discharge port is blocked from the light, and other portions are irradiated with the light, which allows the negative type resist to be cured. At this point, the resin of the ink-repellent layer 4 is also cured at the same time, and then the development is performed to an ink discharge port 7. The developing solution for the negative type resist layer 3 and the ink-repellent layer 4, the developing solution in which the exposed portion is not dissolved, the unexposed portion can perfectly be removed and the photodegradable positive type resist arranged beneath the unexposed portion is not dissolved, is optimum. The mixed solvent of methyl isobutyl ketone, xylene, or methyl isobutyl ketone/xylene and the like can be used. Because the plural heads are generally arranged on one substrate and used as the ink jet head through the cutting process, the positive type resist forming the ink flow path pattern is dissolved and removed after a cutting process as a dust measurement during the cutting. This is because it is important the photodegradable positive type resist is not dissolved.

Process 5: Ink Supply Port and Ink Flow Path Formation

Figure 5:
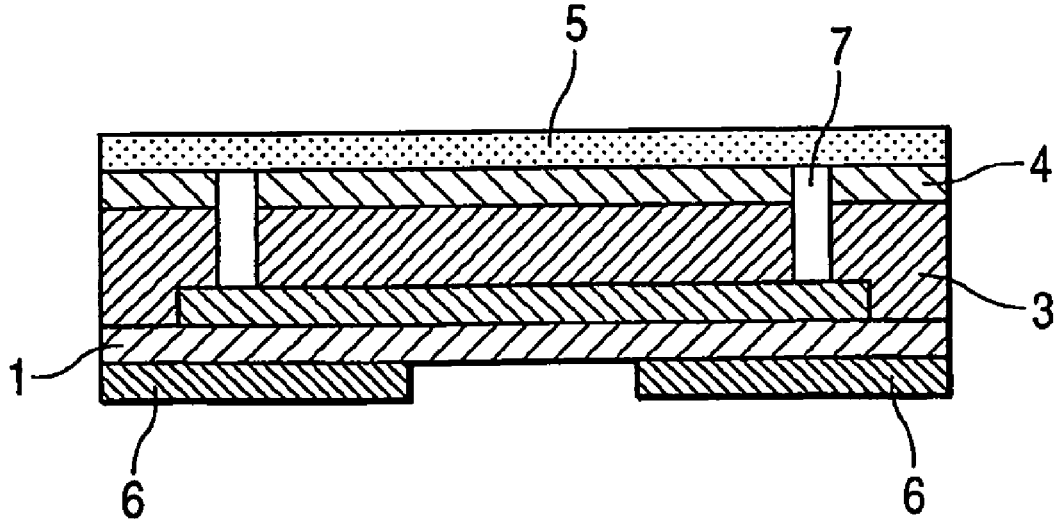
FIG. 5 is a schematic sectional view showing a state in which a protection layer and an etching mask are formed.
Figure 6:
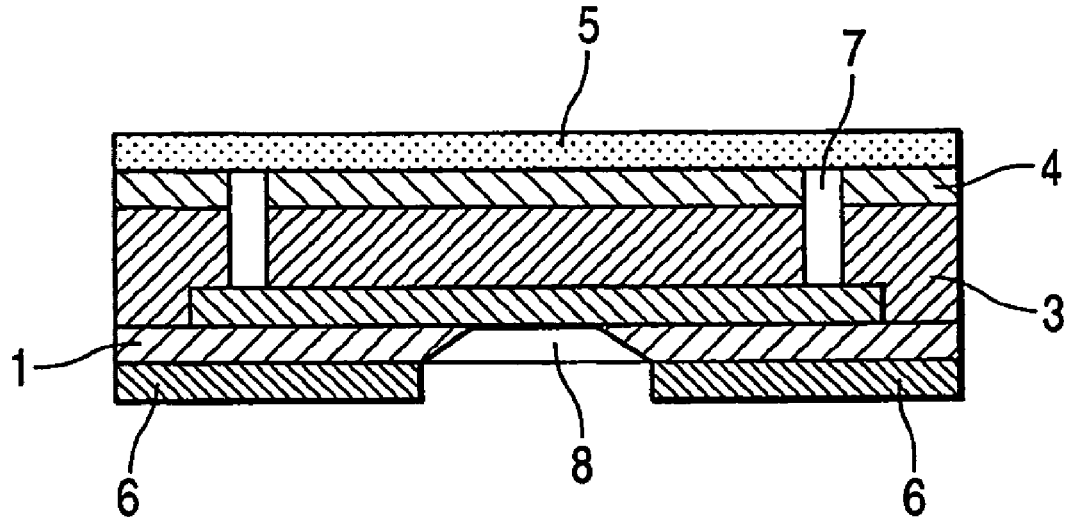
FIG. 6 is a schematic sectional view showing a state in which an ink supply port is formed.

Then, an ink supply port 8 piercing the substrate 1 is formed (FIGS. 5 and 6). Although the anisotropic etching or the dry etching is usually used as the method of forming the ink supply port 8, the method is not limited to the anisotropic etching or the dry etching. The anisotropic etching method in which the Si substrate having a specific crystal orientation is used will be described as an example. First, an etching mask 6 (for example, HIMAL produced by Hitachi Chemical Co., Ltd.) is formed in the backside of the substrate 1 while only a slit portion having the size of the ink supply port is left (FIG. 5). Then, the etching mask 6 is dipped while warming into an etching solution. The etching solution which is of an alkaline etching solution including water solutions of potassium hydroxide, sodium hydroxide, tetramethyl ammonium hydroxide, and the like. Therefore, only the portion exposed from the slit portion in the substrate can be dissolved with anisotropy, and the ink supply port 8 can be formed (FIG. 6). Then, the etching mask 6 is removed as necessary. At this point, in order to protect the negative type resist layer 3 and the ink-repellent layer 4 on the surface of the substrate from the etching solution, it is also possible that the resin having the etching solution-resistance properties (for example, OBC produced by TOKYO OHKA KOGYO CO., LTD.) is formed on the substrate surface as a protection layer 5.

Figure 7:
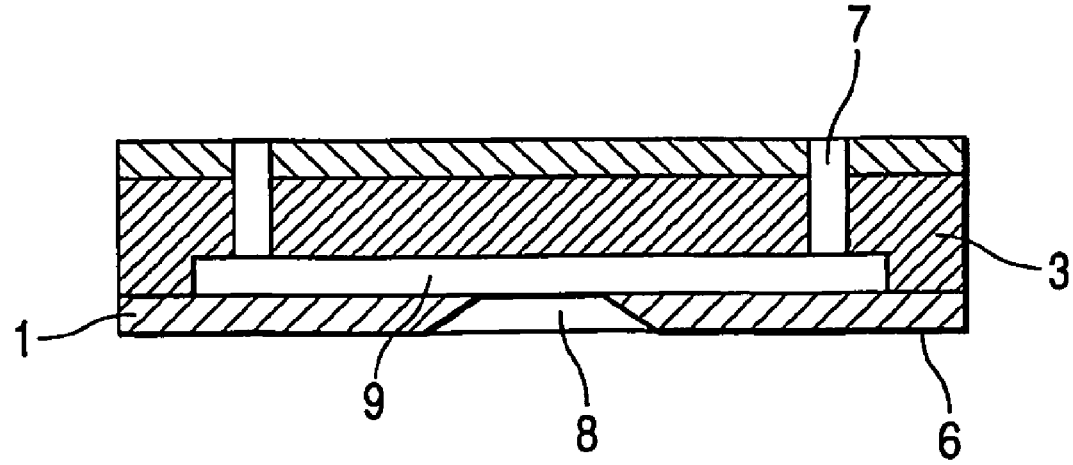
FIG. 7 is a schematic sectional view showing a structure of an ink jet head in which the ink flow path is formed.

Then, the positive type resist forming the ink flow path pattern is removed to form the ink flow path communicated with the ink discharge port (FIG. 7). In this process, the positive type resist forming the ink flow path pattern is irradiated with the ionizing radiation to generate the degradation reaction of the positive type resist, which improves the solubility for the removing solution. The same ionizing radiation as for the patterning of the positive type resist layer 2 can be used. However, because the purpose of the process is to form the ink flow path by removing the structure which becomes the ink flow path, irradiation of the ionizing radiation can be performed over the surface with no mask. Then, it is possible that the positive type resist forming the ink flow path pattern is perfectly removed with the same developing solution as for the patterning of the positive type resist layer 2. However, in this process, the positive type resist can be dissolved without considering the patterning properties, and the solvent which does not affect the negative type resist layer and the ink-repellent layer can be used. The ink jet head can be produced in the above-described process.

In the method of manufacturing the ink jet head using the acrylic copolymer described in the invention, any ink jet head manufacturing method is included in the invention independently of the mode as long as the materials are used in the discharge port forming area.

The invention will be described below in further detail by Examples.

EXAMPLE 1

In Example 1, the ink jet head was manufactured by a method for manufacturing an ink jet head shown by FIGS. 1 to 7. First, the silicon substrate 1 in which the energy generating element for discharging the ink and the silicon substrate 1 on which a driver and a logic circuit were formed was prepared. Then, the positive type resist layer 2 including the photodegradable positive type resist was formed on the substrate 1 (FIG. 1). With reference to the photodegradable positive type resist, a resist solution, in which

- methyl methacrylate (MMA)/methacrylic acid (MAA) copolymer,
- MMA/MAA=90/10 (weight ratio), and
- weight average molecular weight=170000 (conversion of polystylene)

were dissolved in diethylene glycol dimethyl ether at a solid content concentration of 25 weight %, was applied by the spin coating method. The applied resist solution was pre-baked on a hot plate at a temperature of 100° C. for three minutes, and the pre-baking was further performed in a nitrogen-replaced oven at a temperature of 150° C. for one hour to form the positive type resist layer 2 having the film thickness of 14 μm (FIG. 1). When the carboxyl group was identified the amount of hydroxyl group derived from the carboxyl group included in methacrylic acid in the resin with IR, the carboxyl group used for the intermolecular crosslinking was not more than 20%.

Then, the positive type resist layer 2 was irradiated with Deep-UV light at exposure of 50000 mJ/cm$^2$ through a mask, in which the flow path pattern was drawn, using a Deep-UV exposure apparatus UX-3000 (product name of USHIO INC.)—Then, the positive, type resist layer 2 was developed with a mixed solution having the following composition:

- diethylene glycol monobutyl ether: 60 vol %,
- monoethanolamine: 5 vol %,
- morpholine: 20 vol %, and
- ion-exchanged water: 15 vol %.

Then, the ink flow path pattern was formed by performing a rinsing treatment with isopropyl alcohol (FIG. 2).

Then, the ink flow path pattern was coated with the negative type resist (FIG. 3). The resist solution having the following composition was used as the negative type resist:

- epoxy resin: EHPE-3150 (product name of DAISEL CHEMICAL INDUSTRIES, LTD.): 100 weight parts,
- silane coupling agent: A-187 (product name of Nippon Unicar Company Limited): 5 weight parts,
- photopolymerization initiator: SP170 (product name of ASAHI DENKA CO., LTD.): 2 weight parts,
- addition agent: HFAB (product name of CENTRAL GLASS CO., LTD.): 20 weight parts, and
- solvent: xylene: 80 weight parts.

The negative type resist was applied by the spin coating method, and the pre-baking was performed on the hot plate at 90° C. for three minutes to form the negative type resist layer 3 having the thickness of 20 μm (on flat plate). The photosensitive ink-repellent layer 4 made of the resin having the following composition was formed on the negative type resist layer 3 by the laminating method:

- epoxy resin: EHPE-3150 (product name of DAISEL CHEMICAL INDUSTRIES, LTD): 35 weight parts,
- 2,2-bis(4-glycidyl oxyphenyl)hexafluoropropane: 25 weight parts,
- 1,4-bis(2-hydroxyhexafluoroisopropyl)benzene: 25 weight parts,
- 3-(2-perfluorohexyl)ethoxy-1,2-epoxypropane: 16 weight parts,
- silane coupling agent: A-187 (product name of Nippon Unicar Company Limited): 4 weight parts,
- photopolymerization initiator: SP170 (product name of ASAHI DENKA CO., LTD): 1.5 weight parts, and
- diethylene glycol monoethyl ether: 200 weight parts.

Then, the pattern exposure was performed at the exposure of 300 mJ/cm$^2$ through the mask, in which the ink discharge port pattern was drawn, using a mask aligner MPA600FA (product name of Canon Inc.).

Then, PEB was performed at 90° C. for 180 seconds, the development was performed with the solution of methyl isobutyl ketone/xylene=2/3, and the rinsing treatment was performed with xylene, which formed the ink discharge port 7 (FIG. 4 ).

Then, the ink supply port 8 was formed on the backside of the substrate 1 by the etching treatment. OBC (product name of TOKYO OHKA KOGYO CO., LTD.) was applied as the protection layer 5 over the surface of the ink-repellent layer 4. Then, the slit-shaped etching mask 6 was formed on the backside of the substrate with a polyetheramide resin HIMAL (product name of Hitachi Chemical Co., Ltd.) (FIG. 5), and anisotropic etching was performed to the silicon substrate to form the ink supply port 8 by dipping the etching mask 6 into a tetramethyl ammonium hydroxide water solution at 80° C. (FIG. 6). It is possible that the etching mask 6 is previously formed when the substrate is prepared.

After OBC (product name) which was of the protection layer 5 was removed with xylene, the positive type resist forming the ink flow path pattern was solubilized by exposing the ink flow path pattern at the exposure of 70000 mJ/cm$^2$ from above the ink-repellent layer 4 using the Deep-UV exposure apparatus UX-3000 (product name of USHIO INC.). The ink flow path pattern was removed by dipping the ink flow path pattern into methyl lactate while ultrasound is applied, and the ink jet head shown in FIG. 7 was formed.

When the carboxyl group. was identified from the amount of hydroxyl group derived from the carboxyl group included in methacrylic acid in the resin with IR, the carboxyl group used for the intermolecular crosslinking was not more than 20%.

In the ink jet head produced by the above-described method, the crack and the dissolution and deformation of the positive type resist layer 2 were not observed.

When the ink jet head produced by the above-described method was mounted on a printer to perform discharge and recording evaluations, stable printing could be realized and the high-quality printed matter was obtained.

EXAMPLE 2

The ink jet head was produced in the same manner as for Example 1 except that the resin shown below was used as the positive type resist layer 2:

methyl methacrylate (MMA)/methacrylic acid (MAA) copolymer,

MMA/MAA=90/10 (weight ratio), and weight average molecular weight=72000 (conversion of polystylene).

In the IR measurement similar to Example 1, the carboxyl group used for the intermolecular crosslinking was not more than 20%.

In the ink jet head produced by the above-described method, the crack and the dissolution and deformation of the positive type resist layer 2 were not observed. When the ink jet head produced by the above-described method was mounted on the printer to perform the discharge and recording evaluations, the stable printing could be realized and the high-quality printed matter was obtained.

EXAMPLE 3

The ink jet head was produced in the same manner as for Example 1 except that the resin shown below was used as the positive type resist layer 2:

methyl methacrylate (MMA)/methacrylic acid (MAA) copolymer,

MMA/MAA=90/10 (weight ratio), and weight average molecular weight=220000 (conversion of polystylene).

In the IR measurement similar to Example 1, the carboxyl group used for the intermolecular crosslinking was not more than 20%.

In the ink jet head produced by the above-described method, the crack and the dissolution and deformation of the positive type resist layer 2 were not observed. When the ink jet head produced by the above-described method was mounted on the printer to perform the discharge and recording evaluations, the stable printing could be realized and the high-quality printed matter was obtained.

EXAMPLE 4

The ink jet head was produced in the same manner as for Example 1 except that the resin shown below was used as the positive type resist layer 2 and the exposure was set at 68000 mJ/cm$^2$ during the patterning:

methyl methacrylate (MMA)/methacrylic acid (MAA) copolymer,

MMA/MAA=93/7 (weight ratio), and weight average molecular weight=170000 (conversion of polystylene).

In the IR measurement similar to Example 1, the carboxyl group used for the intermolecular crosslinking was not more than 20%.

In the ink jet head produced by the above-described method, the crack and the dissolution and deformation of the positive type resist layer 2 were not observed. When the ink jet head produced by the above-described method was mounted on the printer to perform the discharge and recording evaluations, the stable printing could be realized and the high-quality printed matter was obtained.

EXAMPLE 5

The ink jet head was produced in the same manner as for Example 1 except that the resin shown below was used as the positive type resist layer 2 and the exposure was set at 42000 mJ/cm$^2$ during the patterning:

methyl methacrylate (MMA)/methacrylic acid (MAA) copolymer,

MMA/MAA=85/15 (weight ratio), and weight average molecular weight=170000 (conversion of polystylene).

In the IR measurement similar to Example 1, the carboxyl group used for the intermolecular crosslinking was not more than 20%.

In the ink jet head produced by the above-described method, the crack and the dissolution and deformation of the positive type resist layer 2 were not observed. When the ink jet head produced by the above-described method was mounted on the printer to perform the discharge and recording evaluations, the stable printing could be realized and the high-quality printed matter was obtained.

EXAMPLE 6

The ink jet head was produced in the same manner as for Example 1 except that the mixed solution having the following composition was used as the developing solution for positive type resist layer 2:

diethylene glycol monobutyl ether: 55 vol % monoethanolamine: 5 vol % morpholine: 20 vol % ion-exchanged water: 20 vol %

In the ink jet head produced by the above-described method, the crack and the dissolution and deformation of the positive type resist layer 2 were not observed. When the ink jet head produced by the above-described method was mounted on the printer to perform the discharge and recording evaluations, the stable printing could be realized and the high-quality printed matter was obtained.

COMPARATIVE EXAMPLE 1

The ink jet head was produced in the same manner as for Example 1 except that the resin having the following composition was used as the positive type resist layer and the following process was used for the positive type resist layer.

In the photodegradable positive type resist forming the positive type resist layer 2, polymethyl isopropenyl ketone ODUR-1010 (product name of TOKYO OHKA KOGYO CO., LTD.) was adjusted so that resin concentration became 20 wt %, and the photodegradable positive type resist was applied by the spin coating method. The photodegradable positive type resist was pre-baked on the hot plate at a temperature of 120° C. for three minutes, and the pre-baking was further performed in the nitrogen-replaced oven at 150° C. for 30 minutes to form the positive type resist layer 2 having the film thickness of 15 μiα (FIG. 1). Then, the positive type resist layer 2 was irradiated with the Deep-UV light through the mask, in which the flow path pattern was drawn, using the Deep-UV exposure apparatus UX-3000 (product name). Then, the development was performed with the solution of methyl isobutyl ketone (MIBK)/xylene=2/3 which was of the non-polar solvent and the rinsing treatment was performed with xylene, which formed the ink flow path pattern (FIG. 2 ). In the ink jet head produced by the above-described method, the slight deformation of the positive type resist layer 2 was confirmed while the crack was not observed.

COMPARATIVE EXAMPLE 2

The ink jet head was produced in the same manner as for Example 1 except that the process of forming the positive type resist layer 2 was changed as follows: The intermolecular crosslinking was caused to progress by performing the pre-baking in the nitrogen-replaced oven at a temperature of 200° C. for one hour, and the positive type resist layer 2 having the film thickness of 13 μm was formed. When the carboxyl group was identified from the amount of hydroxyl group derived from the carboxyl group included in methacrylic acid in the resin with IR, the carboxyl group used for the intermolecular crosslinking was not lower than 80%. In the ink jet head produced by the above-described method, although the positive type resist layer was slightly dissolved and deformed, the sensitivity was lowered. Therefore, the exposures not lower than 65000 mJ/cm$^2$ was required for the patterning.

COMPARATIVE EXAMPLE 3

The ink jet head was produced in the same manner as for Example 1 except that the resin having the following composition and process were used as the positive type resist layer 2:

methyl methacrylate (MMA)/methacrylic acid (MAA) copolymer (MMA/MAA=97/3 (weight ratio), weight average molecular weight=33000 (conversion of polystylene)).

The resist solution, in which the resin particles of the MMA/MAA copolymer were dissolved in cyclohexanone at the solid content concentration of about 30 weight %, was applied by the spin coating method. Then, the applied resist solution was pre-baked on the hot plate at a temperature of 120° C. for three minutes to form the positive type resist layer 2 having the film thickness of 15 μm (FIG. 1). When the carboxyl group was identified from the amount of hydroxyl group derived from the carboxyl group included in methacrylic acid in the resin with IR, the carboxyl group used for the intermolecular crosslinking was not more than 20%. Then, the positive type resist layer 2 was irradiated with the Deep-UV light at through the mask, in which the flow path pattern was drawn, using the Deep-UV exposure apparatus UX-3000 (product name of USHIO INC.). Then, the positive type resist layer 2 was developed with the solution of methyl isobutyl ketone (MIBK)/xylene=2/3 which was of the non-polar solvent and the rinsing treatment was performed with xylene, which formed the ink flow path pattern (FIG. 2). In the ink jet head produced by the above-described method, although the dissolution and the deformation of the positive type resist layer were not observed, the sensitivity was lowered. Therefore, the exposures not lower than 60000 mJ/cm$^2$ was required for the patterning, and the crack was generated during the development.

COMPARATIVE EXAMPLE 4

The ink jet head was produced in the same manner as for Example 1 except that the process of forming the positive type resist layer 2 was changed as follows: The intermolecular crosslinking was caused to progress by performing the pre-baking in the nitrogen-replaced oven at a temperature of 200° C. for one hour, and the positive type resist layer 2 having the film thickness of 14 μm was formed. When the carboxyl group was identified from the amount of hydroxyl group derived from the carboxyl group included in methacrylic acid in the resin with IR, the carboxyl group used for the intermolecular crosslinking was not lower than 80%. Then, the positive, type resist layer 2 was irradiated with the Deep-UV light at through the mask, in which the flow path pattern was drawn, using the Deep-UV exposure apparatus UX-3000 (product name of USHIO INC.). Then, the positive type resist layer 2 was developed with the solution of methyl isobutyl ketone (MIBK)/xylene=2/3 which was of the non-polar solvent and the rinsing treatment was performed with xylene, which formed the ink flow path pattern (FIG. 2 ). In the ink jet head produced by the above-described method, although the positive type resist layer was slightly dissolved and deformed, the sensitivity was lowered. Therefore, the exposures not lower than 65000 mJ/crα was required for the patterning.

COMPARATIVE EXAMPLE 5

The ink jet head was produced in the same manner as for Example 1 except that the resin having the following composition and process were used as the positive type resist layer 2:

methyl methacrylate (MMA)/methacrylic acid (MAA) copolymer (MMA/MAA=97/3 (weight ratio) weight average molecular weight=33000 (conversion of polystylene)).

The resist solution, in which the resin particles of the MMA/MAA copolymer were dissolved in cyclohexanone at the solid content concentration of about 30 weight %, was applied by the spin coating method. Then, the resist solution applied was pre-baked on the hot plate at a temperature of 120° C. for three minutes, the intermolecular crosslinking was caused to progress by performing the pre-baking in the nitrogen-replaced oven at a temperature of 200° C. for one hour, and the positive type resist layer 2 having the film thickness of 15 μm was formed. When the carboxyl group was identified from the amount of hydroxyl group derived from the carboxyl group included in methacrylic acid in the resin with IR, the carboxyl group used for the intermolecular crosslinking was not lower than 80% (FIG. 1). In the ink jet head produced by the above-described method, the dissolution and the deformation of the positive type resist layer were observed, and the sensitivity was lowered. Therefore, the exposures not lower than 70000 mJ/cm$^2$ was required for the patterning.

This application claims priority from Japanese Patent Application No. 2004-190480 filed on Jun. 28, 2004, which is hereby incorporated by reference herein.

The invention claimed is:

1. A method for manufacturing an ink jet head which includes a discharge port for discharging an ink droplet, an ink flow path communicated with the discharge port, and an energy generating element for discharging the ink droplet from the discharge port, the method for manufacturing an ink jet head comprising:

a process of providing a photodegradable resin layer on a substrate having the energy generating element, the photodegradable resin layer including a binary acrylic copolymer composition, the binary acrylic copolymer composition containing a plurality of binary acrylic copolymers containing a unit obtained from (meth) acrylic ester as a main component, the binary acrylic copolymer further containing a unit obtained from (meth) acrylic acid, the binary acrylic copolymer composition containing the (meth) acrylic acid unit at a proportion of 5 to 30 weight %, and a weight average molecular weight of the binary acrylic copolymer ranging from 50000 to 300000;

a process of intermolecular crosslinking acrylic copolymers, the number of carboxyl group used for the intermolecular crosslinking being not more than 20% of the number of carboxyl group included in the unit obtained from (meth) acrylic acid in the acrylic copolymer in the acrylic copolymer composition;

a process of forming a structure which becomes the ink flow path by exposing and developing the photodegradable resin layer;

a process of coating the substrate having the structure which becomes the ink flow path with a negative type photosensitive resin layer;

a process of forming the ink discharge port in the negative type photosensitive resin layer; and a process of forming the ink flow path communicated with the discharge port by removing the structure which becomes the ink flow path, wherein a developing solution is used in the process of forming the structure which becomes the ink flow path, the developing solution containing glycol ether having carbon numbers not lower than 6, the glycol ether being mixable with water at an arbitrary proportion, a nitrogen-containing basic organic solvent, and water.

2. A method for manufacturing an ink jet head according to claim 1, wherein the (meth) acrylic ester is expressed by General Formula (1) and the (meth) acrylic acid is expressed by General Formula (2), General Formula (1)

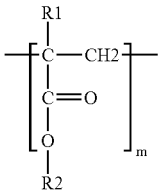

(where R1 is a hydrogen or an alkyl group in which carbon numbers range from 1 to 3, R2 is an alkyl group in which the carbon numbers range from 1 to 3, and m is a positive integer)

General Formula (2)

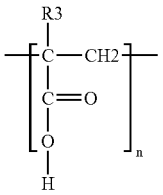

(where R3 is a hydrogen or an alkyl group in which carbon numbers range from 1 to 3 and n is a positive integer).

3. A method for manufacturing an ink jet head according to claim 1, wherein the (meth) acrylic ester includes methacrylate ester.

4. A method for manufacturing an ink jet head according to claim 1, wherein the (meth) acrylic acid is methacrylic acid.

5. A method for manufacturing an ink jet head according to claim 1, wherein the (meth) acrylic ester includes methacrylate ester, and the (meth) acrylic acid is methacrylic acid.

6. A method for manufacturing an ink jet head according to claim 1, wherein the glycol ether is at least one of ethylene glycol monobutyl ether and diethylene glycol monobutyl ether.

7. A method for manufacturing an ink jet head according to claim 1, wherein the nitrogen-containing basic organic solvent is at least one of ethanolamine and morpholine.

8. A method for manufacturing an ink jet head according to claim 1, wherein a solvent used for a coating resin mainly containing methyl isobutyl ketone and/or xylene is used in the process of coating with the negative type photosensitive resin layer.

9. A method for manufacturing an ink jet head according to claim 1, wherein the weight average molecular weight of the binary acrylic copolymer composition is greater than 50000 and not greater than 300000.

10. A method for manufacturing an ink jet head according to claim 9, wherein the weight average molecular weight of the binary acrylic copolymer composition ranges from 170000 to 300000.

11. A method for manufacturing an ink jet head which includes a discharge port for discharging an ink droplet, an ink flow path communicated with the discharge port, and an energy generating element for discharging the ink droplet from the discharge port, the method for manufacturing an ink jet head comprising:

a process of providing a photodegradable resin layer on a substrate having the energy generating element, the photodegradable resin layer including a binary acrylic copolymer composition, the binary acrylic copolymer composition containing a plurality of binary acrylic copolymers containing a unit obtained from (meth) acrylic ester as a main component, the binary acrylic copolymer further containing a unit obtained from (meth) acrylic acid, the binary acrylic copolymer composition containing the (meth) acrylic acid unit at a proportion of 5 to 30 weight %, and a weight average molecular weight of the binary acrylic copolymer ranging from 50000 to 300000;

a process of intermolecular crosslinking acrylic copolymers, the number of carboxyl group used for the intermolecular crosslinking being not more than 20% of the number of carboxyl group included in the unit obtained from (meth) acrylic acid in the acrylic copolymer in the acrylic copolymer composition;

a process of forming a structure which becomes the ink flow path by exposing and developing the photodegradable resin layer;

a process of coating the substrate having the structure which becomes the ink flow path with a negative type photosensitive resin layer;

a process of forming the ink discharge port in the negative type photosensitive resin layer; and a process of forming the ink flow path communicated with the discharge port by removing the structure which becomes the ink flow path.

* * * * *